US007201359B2

(12) United States Patent
Hwang

(10) Patent No.: US 7,201,359 B2
(45) Date of Patent: Apr. 10, 2007

(54) MANUAL PRESSING DEVICE FOR A FLUSHER

(75) Inventor: Su Hwang, Nan-Tou (TW)

(73) Assignee: Hydrotek Corporation, Nan-Tou (TW)

( * ) Notice: Subject to any disclaimer, the term of this patent is extended or adjusted under 35 U.S.C. 154(b) by 314 days.

(21) Appl. No.: 10/873,181

(22) Filed: Jun. 23, 2004

(65) Prior Publication Data

US 2005/0283897 A1 Dec. 29, 2005

(51) Int. Cl.
*F16K 31/12* (2006.01)

(52) U.S. Cl. ..... 251/33; 251/322

(58) Field of Classification Search ..... 251/25, 251/33, 322

See application file for complete search history.

(56) References Cited

U.S. PATENT DOCUMENTS 1,241,878 A * 10/1917 Peerstone ..... 251/74
3,741,518 A * 6/1973 Engstrom ..... 251/44
5,699,994 A * 12/1997 Wu ..... 251/129.03

* cited by examiner

*Primary Examiner*—Eric Keasel
*Assistant Examiner*—John K. Fristoe Jr.
(74) *Attorney, Agent, or Firm*—Troxell Law Office PLLC

(57) ABSTRACT

A manual pressing device for a flusher includes a stop ring, a pressing rod unit, a spring, and a nut. The manual-pressing device is located in a lateral hole of the body of a flusher, normally stopping water in the flusher or pressed to connect a lengthwise hole in the body with a water-exhausting passageway for flushing water. The nut screws with the body to keep the stop ring, the pressing rod unit and the spring stably combined in the lateral hole. When the pressing member of the pressing rod unit fitted with an outer end of the pressing rod is pressed inward, the annular leak recess of the pressing rod unit may communicate with the water exhausting passageway to let water flow therethrough so as to flush water, and releasing the pressing member pressed makes the pressing rod return to its original position to block the water exhausting passageway.

1 Claim, 5 Drawing Sheets

MANUAL PRESSING DEVICE FOR A FLUSHER

BACKGROUND OF THE INVENTION

1. Field of the Invention

This invention relates to a manual pressing device for a flusher, particularly to one able to be pressed with only a little manual force and having a simple structure so as to cut its cost for production, 2. Description of the Prior Art An automatic and manual flusher has an advantage of both automatic and manual operation for flushing water by provision of a sensing device for automatic flushing and a manual-pressing device for manual flushing. Therefore, in case of electric stoppage, it can still flush water by means of a manual pressing device for flushing water. There is a manual flushing device with a flush valve disclosed in a U.S. Pat. No. 5,699,994 by the same inventor of this case, and it includes a flusher body provided with a lateral hole in its lower portion, and a water exhausting passageway communicating with the lateral hole, and a lengthwise hole formed in an annular wall of the upper portion of the body, a chamber formed under the lengthwise hole and communicating with both the lengthwise hole and the lateral hole at the same time. Then a manual pressing device is positioned in the lateral hole so as to be pressed for flushing water through the water-exhausting passageway.

However, the manual-pressing device disclosed in the U.S. Pat. No. 5,699,994 has been found to have the following disadvantages 1. The pressing rod of the manual pressing device has a cross-shaped water exhausting passageway, which must be processed by drilling, complicating the producing process, heighten its cost and making it processed not so correct.
2. Either the pressing rod is pressed down or not, three anti-leak gaskets have to be used for stopping leakage of water, and subsequently these gaskets give rise to frictional resistance in manually pressing the press rod, and in addition, the resilience of the spring may make up some resistance to manual pressing, so the whole resistance against manual pressing becomes substantially large, inconvenient to use.

SUMAMRY OF THE INVENTION

This invention has been devised to offer a manual pressing device for a flusher. The manual-pressing device is positioned in a lateral hole formed in a lower portion of the body of a flusher, consisting of a stop ring, a pressing rod, a cap-shaped pressing member, a spring and a nut. The nut screws with an outer side of the lateral hole to keep the pressing member, the pressing rod and the spring in the lateral hole stably. The pressing rod has an annular leak recess in the inner portion of the outer surface, and the stop ring has a leak hole so as to let water flow through a lengthwise hole of the body into the leak hole and into the annular leak recess. When the pressing member is pressed inward to force the pressing rod with the annular leak recess move inward into the water exhausting passageway, water may flow from the annular leak recess to the water exhausting passageway so as to flush water.

Aside from the flushing function, the manual pressing device in the present invention has only an anti-leak gasket respectively at two locations at two sides of the annular leak recess for effectively perform sealing water leakage from the inner wall surface of the stop ring. So comparing with the three anti-leak gaskets used in the conventional manual pressing device, this device reduces the number of the gaskets needed so the frictional resistance of pressing action of the rod may become smaller to save manual force in operation.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
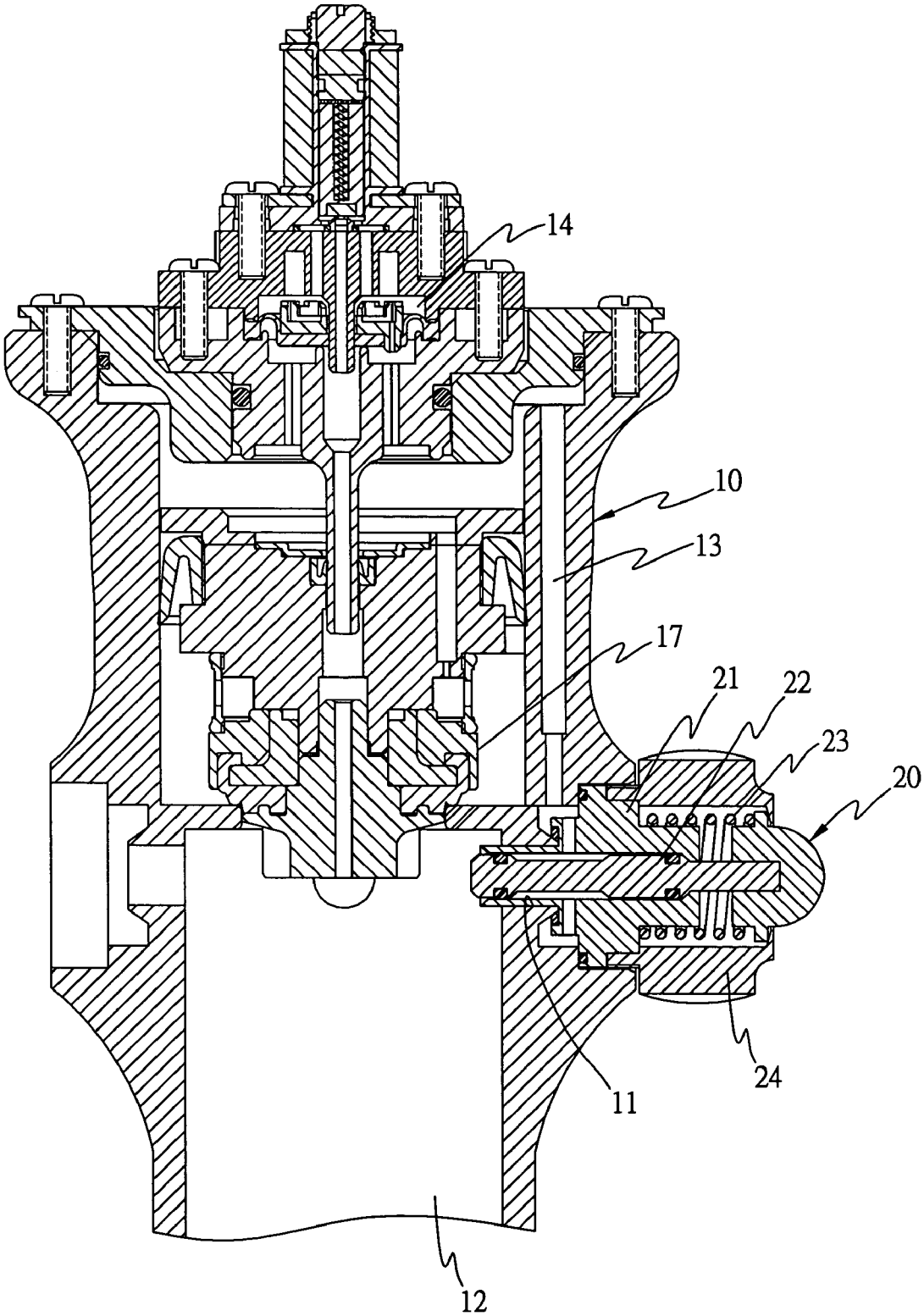
FIG. 1 is a cross-sectional view of a flusher provided with a manual-pressing device in the present invention.
Figure 2:
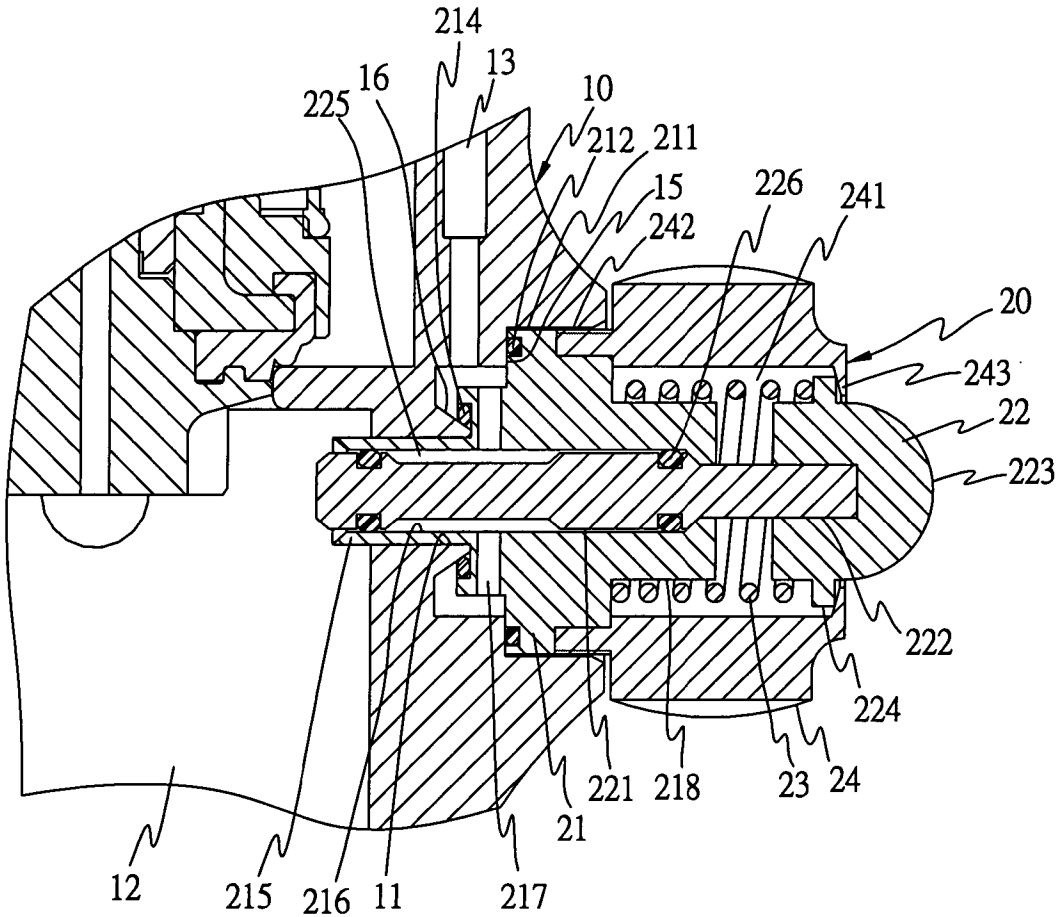
FIG. 2 is a partial cross-sectional view of the flusher with the manual pressing device in the present invention.

A preferred embodiment of a manual pressing device for a flusher in the present invention, as shown in FIG. 1, includes a stop ring 21, a pressing rod unit 22, a spring 23, and a nut 24, combined with a flusher generally having a similar structure as a common conventional one. The flusher has a body 10, a lateral hole formed in a preset location in a lower portion of he body 10 and communicating with a water exhausting passageway 12 in the body 10, a lengthwise hole 13 formed in an annular wall of the body 1 and communicating with both the lateral hole 11 and a chamber 14 formed on the lateral hole 11. Then the manual pressing device 20 is combined and positioned in the lateral hole 11 for normally stopping water between the water exhausting passageway 12 and the lengthwise hole 13 or pressed to let water flowing through the lengthwise hole 13 to the water-exhausting passageway 12 for flushing water.

The stop ring 21 has a stop member 211 formed around its annular wall surface, a water stop gasket 212 fitted in an inner side of the annular wall to contact tightly on a first contact wall 15 defining the lateral hole 11 to prevent water from leaking through the lengthwise hole 13. The stop ring 21 further has a projecting member 213 extending inward from the inner wall, and a water stop gasket 214 fitted in the inner wall defining the projecting member 213 to contact tightly with a second contact wall 16 defining the lateral wall 11 of the body 10 to prevent water from leaking through the lengthwise hole 13. Further, a tubular wall 215 extends lengthwise inward from the projecting member 213 and across the lateral hole 11 into the interior of the water-exhausting passageway 12. The stop ring 21 further has a center slide hole 216 formed to extend along the tubular wall 215 into the water exhausting passageway 12, and two leaking holes 217 are formed vertically to the projecting member 213 and communicating with both the lengthwise hole 13 and the center slide hole 216. In addition, the stop ring 21 has a spring fitting member 218 of a smaller diameter than the body of the stop ring 21 formed to extend lengthwise outward.

The pressing rod unit 22 consists of a large diameter rod member 221 and a small diameter rod member 222 extending outward from the large diameter rod member 221 and a cap-shaped pressing member 223 fitting with the outer end of the small diameter rod member 222. The small diameter rod member 222 fits in the center slide hole 216 of the stop ring 21, and the large diameter rod member 221 also fits in the center slide hole 216 with its inner end exposed in the water exhausting passageway 12. The cap-shaped pressing member 223 has an annular projection 224 on its outer surface.

The larger diameter rod member 221 has a annular leak recess 225 of a certain length in its outer surface to communicate with the leak hole 217 of the stop ring 21 to let water in the lengthwise hole 13 of the body 10 flow through the leak hole 217 into the annular leak recess 225. Further, a water stop gasket 226 is provided to fit around two locations at two sides of the leak recess 225 and contact tightly with the inner wall surface of the center slide hole 216 to prevent water from leaking inward or outward from the leak recess 225. When the cap-shaped pressing member 223 is pressed inward to force the large diameter rod member 221 with the leak recess 225 together with the small diameter rod member 222 to slide in the water exhausting passageway 12, the water in the lengthwise hole 13 of the body 10 can flow into the water exhausting passageway 12 via the leak recess 225 for flushing.

Figure 3:
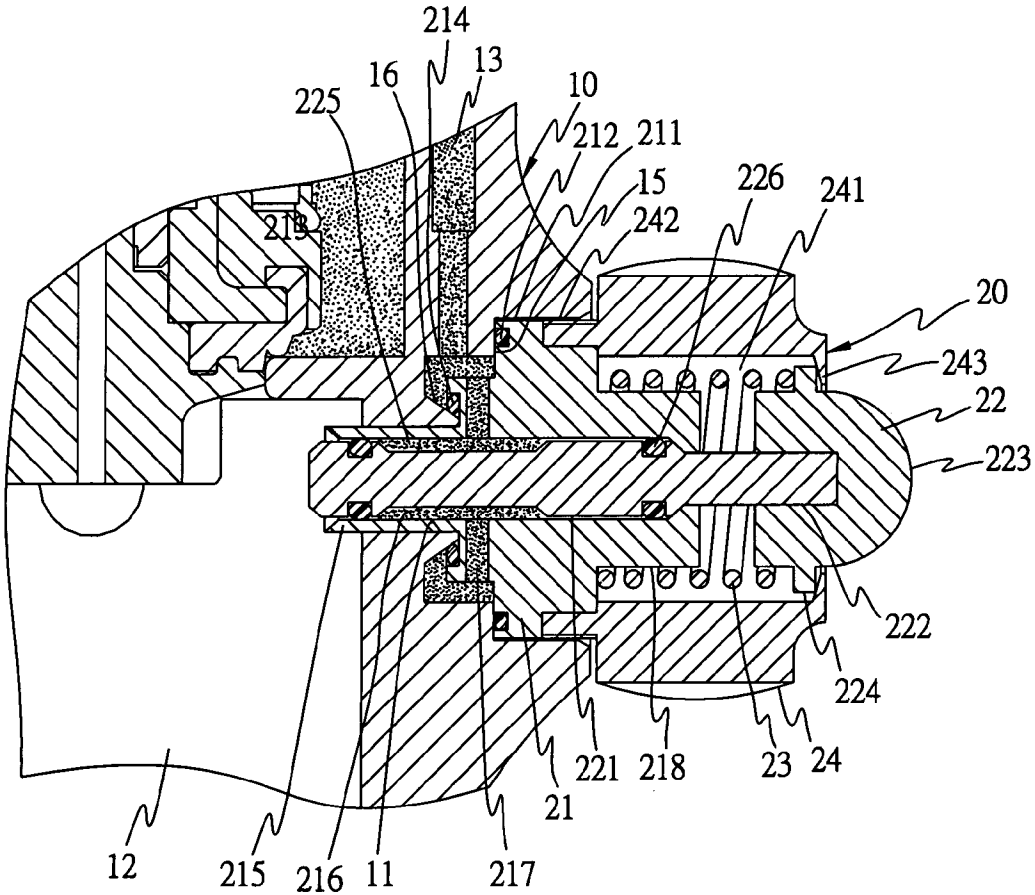
FIG. 3 is a partial cross-sectional view of the flusher with the manual-pressing device in the present invention, showing it under a normal water-stopped condition.
Figure 4:
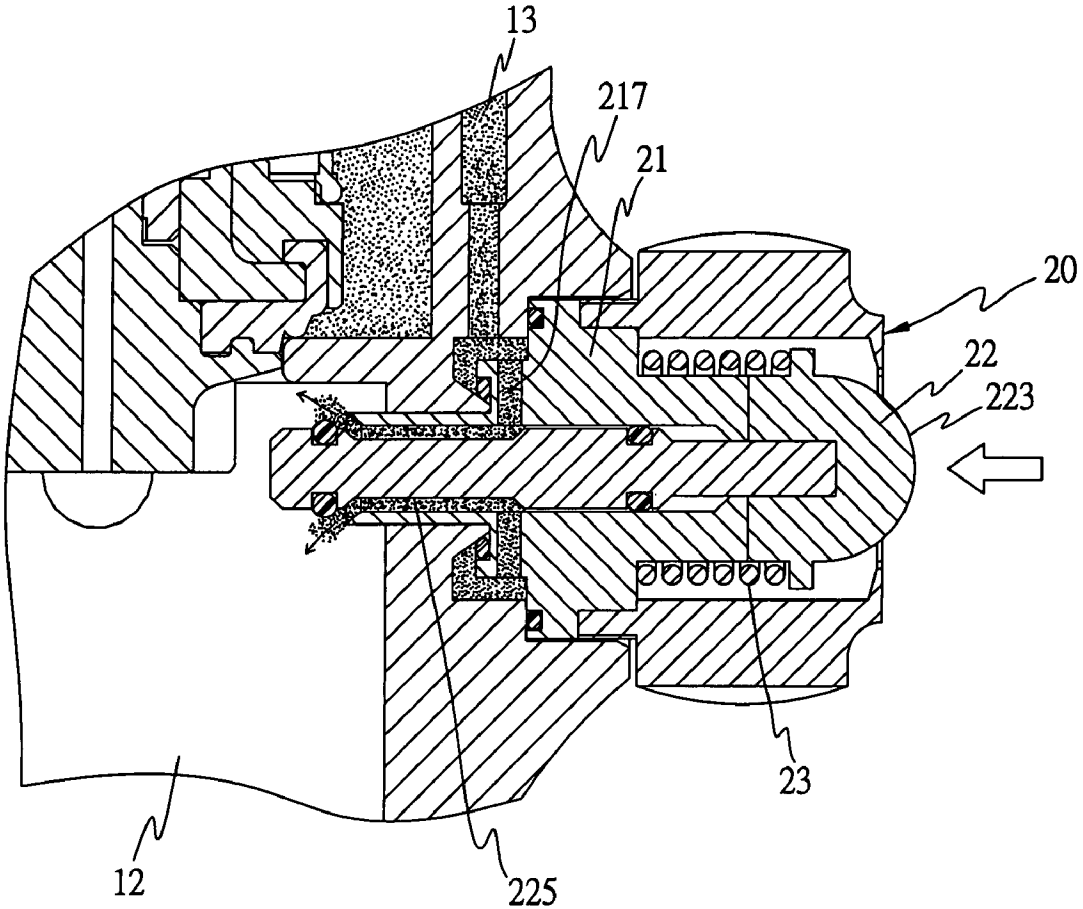
FIG. 4 is a partial cross-sectional view of the flusher with the manual pressing device in the present invention, showing the initial condition of the pressing rod pressed for flushing water; and, FIG. 5 is a partial cross-sectional view of the flusher with the manual-pressing device in the present invention, showing a flushing condition after the pressing rod pressed.
Figure 5:
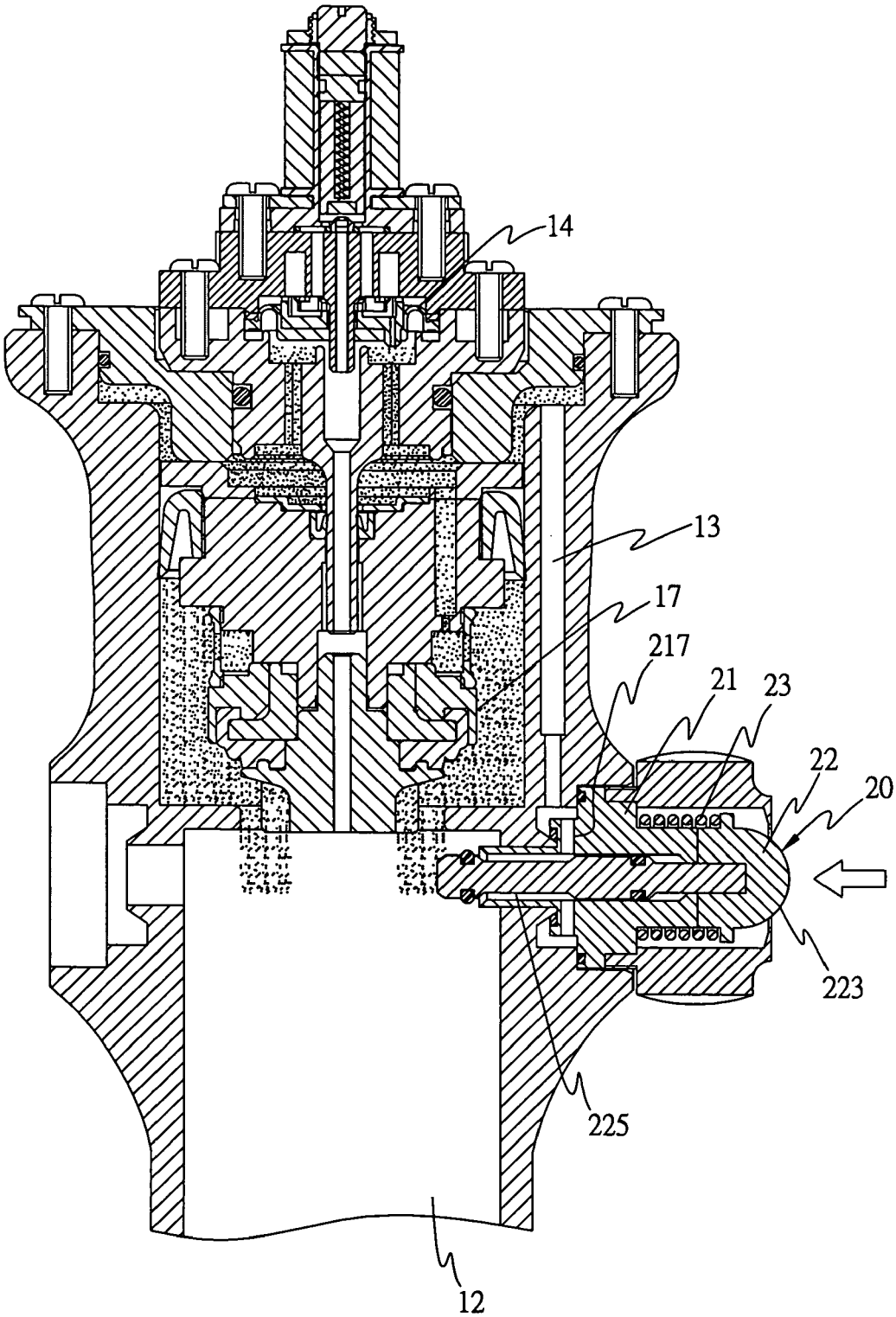

In using, referring to FIG. 3, when the flusher is under the not-operated condition for flushing water, water in the lengthwise hole 13 of the body 10 may flow into the leak recess 225 of the pressing rod 22, but not flow into the water exhausting passageway, because the leak recess 225 is not in the communicating condition with the water exhausting passageway 12. Then if a user wants to flush water manually, the user presses inward the exposed out pressing member 223 of the pressing rod unit 22, overcoming the resilience of the spring 23. Then when the leak recess 225 of the pressing rod 22 slides inward into the water exhausting passageway 12, the water in the lengthwise hole 13 may flow through the leak hole 217 into the leak recess 225 and finally into the water exhausting passageway 12. As shown in FIG. 5, the water in the chamber 14 of the body 10 may flow through the lengthwise hole 13 and finally into the water-exhausting passageway 12 as just mentioned. Then the water stop valve 17 may be opened to let water finally flow into the water-exhausting passageway 12 to complete one round of flushing action. It is evident that if the user releases the finger pressing the pressing member 223, the pressing device unit 22 will automatically be returned to its original position by resilience of the spring 23, ready for next round of flushing action.

Lastly, the manual pressing device for a flusher according to the present invention may be understood to have the following advantages, 1. The pressing rod 22 needs only two anti-leak gaskets 226 to obtain the effect of preventing water from leaking, so frictional resistance produced by the gaskets 26 is far weaker than the conventional one, and in addition, water flowing in the leak recess 225 can help sliding effect to cut down whole resistance against pressing force of a finger, saving manual force needed in flushing action.
2. The pressing rod unit 22 needs not any complicated process such as drilling, saving time and labor to cut its cost.

While the preferred embodiment of the invention has been described above, it will be recognized and understood that various modifications may be made therein, and the appended claims are intended to cover all such modifications that may fall within the spirit and scope of the invention.

What is claimed is:

1. A manual pressing device for a flusher, said flusher including a lateral hole formed in a lower portion of a body of said flusher, a water exhausting passageway formed lengthwise below said lateral hole and possible to communicate with said lateral hole, a lengthwise hole formed in an annular wall of said body and communicating with a chamber formed thereon and also with said lateral hole, said manual pressing device provided in said lateral hole and normally stopping water from flowing from said lengthwise hole into said water exhausting passageway and pressed to permit water flow through the lengthwise hole into said water exhausting passageway, said manual pressing device comprising:

a stop ring fitted firmly around the wall defining said lateral hole of said body of the flusher and having a center slide hole:

a pressing rod unit located in said center slide hole of said stop ring and consisting of a cap-shaped pressing member and a large diameter rod member and a small diameter rod member extending from said large diameter rod member outward, said large diameter rod member having an annular recess of a certain length formed in an outer surface and communicating with said lengthwise hole of said body, an anti-leak gasket fitted tightly respectively around two locations at two opposite sides of said leak recess of said large diameter rod member for preventing water from leaking, said large diameter rod member and said small diameter rod member possible to be pushed inward by said cap-shaped pressing member fitting with an outer end of said small diameter rod member so that said leak recess may communicate with said water exhausting passageway for water to flow through said lengthwise hole into said water exhausting passageway for flushing:

a spring having an inner end pushing against an outer side of said stop ring and an outer end pushing against an inner side of said cap-shaped pressing member, said spring pushing said large and said small diameter rod member back to their original position after they are pushed inward by said pressing member by means of its resilience after said pressing member is released from pressed: and, a nut having an center hollow for receiving partially said stop ring, said spring, said large diameter and said small diameter rod member, said nut having its inner side screwing with an outer side of the wall defining said lateral hole and sealing said stop ring and limiting said large and said small diameter rod member from moving out of said center slide hole of said stop ring, wherein said stop ring further has an inward lengthwise projection, and an anti-leak gasket fitted in an inner wall of said projection so that said anti-leak gasket contacts tightly with an outer side of the wall defining said lateral hole of said body, and a tubular wall is provided to extend lengthwise inward from said projection and has its outer end extending outward from said lateral hole and exposing in said water exhausting passageway and also its interior hollow connected with said center slide hole of said stop ring, at least a leak hole formed laterally at a preset location of said projection so as to let said lengthwise hole of said body communicate with said leak recess via said leak hole, and said two anti-leak gaskets of said large diameter rod member also contacting tightly with an inner wall surface of said center slide hole.

* * * * *